US007559185B2

(12) United States Patent
Conti

(10) Patent No.: US 7,559,185 B2
(45) Date of Patent: Jul. 14, 2009

(54) APPARATUS FOR MAKING PODS FOR INFUSION PRODUCTS

(75) Inventor: Roberto Conti, Imola (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/578,325

(22) PCT Filed: Jul. 23, 2004

(86) PCT No.: PCT/IB2004/002566

§ 371 (c)(1),
(2), (4) Date: May 4, 2006

(87) PCT Pub. No.: WO2005/056386

PCT Pub. Date: Jun. 23, 2005

(65) Prior Publication Data

US 2007/0130882 A1 Jun. 14, 2007

(30) Foreign Application Priority Data

Dec. 5, 2003 (IT) ..... BO2003A0735

(51) Int. Cl.
*B65B 47/00* (2006.01)

(52) U.S. Cl. ..... 53/559; 53/523; 53/561; 53/453

(58) Field of Classification Search ..... 53/559, 53/523, 526, 561, 591, 453, 436
See application file for complete search history.

(56) References Cited

U.S. PATENT DOCUMENTS 3,418,140 A * 12/1968 Fisher ..... 426/394
3,579,350 A * 5/1971 Rudd et al ..... 426/79
3,813,848 A 6/1974 Romagnoli
4,034,536 A 7/1977 Mahaffy et al.
4,404,787 A 9/1983 Hazelwood
4,437,294 A 3/1984 Romagnoli
4,609,556 A 9/1986 Goedert
5,081,819 A * 1/1992 Cloud ..... 53/453

(Continued)

FOREIGN PATENT DOCUMENTS

EP 0 432 126 A1 6/1991

*Primary Examiner*—Sameh H. Tawfik
(74) *Attorney, Agent, or Firm*—Arent Fox LLP

(57) ABSTRACT

Described is an apparatus (5) for making pods (1) containing respective doses (4) of an infusion product. The apparatus comprises: revolving drum conveyor means (6) with pockets (7) uniformly distributed on it; a line (B) for feeding a first web (12) of filter material which feeds the first web (12) to the conveyor means (6) ; actuating means (8) for moving the first web (12) against the pockets (7) on the revolving drum conveyor means (6) to form on the first web (12) a series of impressions (L); and a second line (A) for feeding a second web (11) of filter material. In the apparatus described, the actuating means (8) comprise, for each pocket (7) on the revolving drum conveyor means (6), at least one forming head (13) coupled with the pocket (7) itself, the forming head (13) being mobile towards and away from the pocket (7) so that it is pressed into the web (12) and impresses the web (12) in the pocket (7) to form the respective impression (L); and suction means (14) acting on the web (12) at the pocket (7) in synchrony with the forming head (13).

13 Claims, 7 Drawing Sheets

U.S. PATENT DOCUMENTS 5,233,813 A 8/1993 Kenney et al.
5,517,805 A * 5/1996 Epstein ..... 53/453
5,806,277 A * 9/1998 Scheifele et al. ..... 53/374.4
6,135,120 A * 10/2000 Lofman et al. ..... 131/112
6,694,707 B2 * 2/2004 Lehner et al. ..... 53/453
2006/0207619 A1 * 9/2006 Conti ..... 131/322

* cited by examiner

APPARATUS FOR MAKING PODS FOR INFUSION PRODUCTS

CROSS-REFERENCE TO RELATED APPLICATION

The application is a National Stage entry of International Application No. PCT/IB2004/00566 filed Jul. 23, 2004, the entire specification claims of which are incorporated herewith by reference.

TECHNICAL FIELD

The present invention relates to an apparatus for making pods containing products for infusion.

BACKGROUND ART

In the current market of products for infusion, such as coffee, barley coffee, tea, camomile and the like, the use of single-dose "pods" has increased considerably and nowadays a very popular way of making hot beverages is to use such pods in specially designed machines, even for household or office use (that is, for small to medium quantities).

Normally, these pods are of the single-dose type, used to brew a single serving of the beverage. This type of pod, to which the present specification refers but without thereby restricting the scope of the inventive concept, usually consists of two portions of filter paper placed one over the other and sealed to enclose a single product dose of substantially circular shape.

A prior art packaging machine for making pods of this kind is described and illustrated in European Patent No. EP 432.126, where the pods are formed according to a process which comprises the steps of: feeding a first web or length of filter paper to a station where suitable means cause the filter paper to be wrinkled or crinkled; moving the web of filter paper along the surface of a forming drum, provided with circular pockets and with suction means which force spaced areas of the filter paper into the pockets in the drum in such a way as to form a succession of substantially circular pouches in the filter paper; filling a dose of product into each pouch by means of a dosing station located downstream of the suction drawing belt in the direction of rotation of the pouch forming drum and consisting of a second revolving drum synchronised with the pouch forming drum; and, lastly, joining the first web of filter paper, with the product-filled pouches in it, to a second web of filter paper fed at a respective sealing station located downstream of the filling station, again relative to the direction of rotation of the forming drum.

The method embodied by the machine described in the aforementioned European Patent has several major disadvantages, especially in connection with the steps of drawing the filter paper by suction to form the pouches.

Indeed, although the method includes a complex step of preparing the web of filter paper in a specific station that crinkles the filter paper to make it suitable for forming the pouches, many of the suction drawn pouches formed in the filter paper in this way are in actual fact faulty, in that they have creases or folds made in them. These creases not only prevent the infusion product subsequently filled into the pouch from spreading uniformly in the pouch itself but may also result in poor seals between the first and second webs.

As a result, the pods made are often defective and have to be rejected since they contain insufficient quantities of infusion product or have improperly sealed parts that create gaps through which the infusion product can escape.

The aim of the present invention is therefore to provide an apparatus for making pods for products for infusion that is free of the disadvantages of the prior art described above and that is capable of consistently making high quality pods.

DISCLOSURE OF THE INVENTION

In accordance with the invention, the above aim is achieved by an apparatus for making pods containing respective doses of an infusion product, the apparatus comprising: revolving drum conveyor means with pockets uniformly distributed on it; a line for feeding a first web of filter material which feeds the first web to the conveyor means; actuating means for moving the first web against the pockets on the revolving drum conveyor means to form on the first web a series of impressions; and a second line for feeding a second web of filter material; the apparatus being characterised in that the actuating means comprise, for each pocket on the revolving drum conveyor means, at least one forming head coupled with the pocket itself, the forming head being mobile towards and away from the pocket so that it is pressed into the web and impresses the web in the pocket to form the respective impression; and suction means acting on the web at the pocket in synchrony with the forming head.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
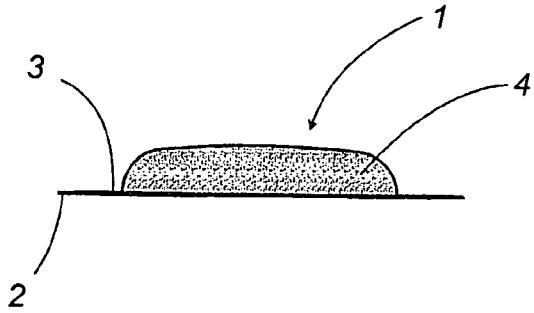
FIG. 1 is a side view of a pod for products for infusion made using the apparatus according to the present invention.
Figure 2:
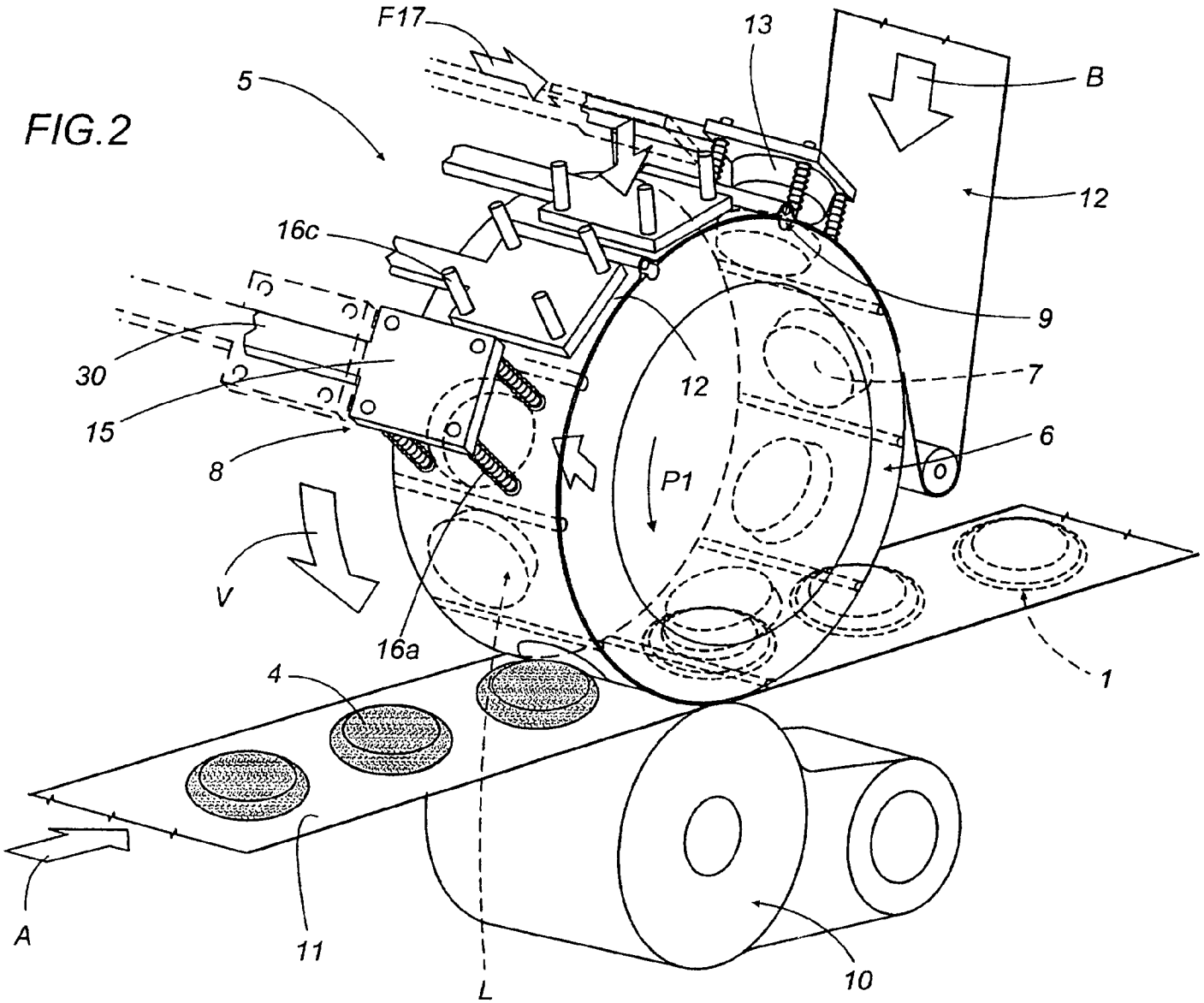
FIG. 2 is a schematic perspective view, with some parts cut away for clarity, of a preferred embodiment of the apparatus for making pods according to the present invention.

With reference to the accompanying drawings, in particular FIGS. 1 and 2, the numeral 5 denotes in its entirety an apparatus for making single-dose pods 1 of filter material containing products for infusion, such as but not restricted to, a blend of ground coffee.

The pods 1 usually have an asymmetrical shape and comprise two portions of filter paper 2 and 3 (FIG. 1) placed one over the other and sealed to enclose a dose 4 of the infusion product.

As shown in FIG. 2, the apparatus 5 for making the pods 1 comprises a line A for feeding a continuous strip or web 11 of filter paper on which a plurality of spaced doses 4 of infusion product are placed, and a line B for feeding a continuous strip or web 12 of filter paper.

Figure 3:
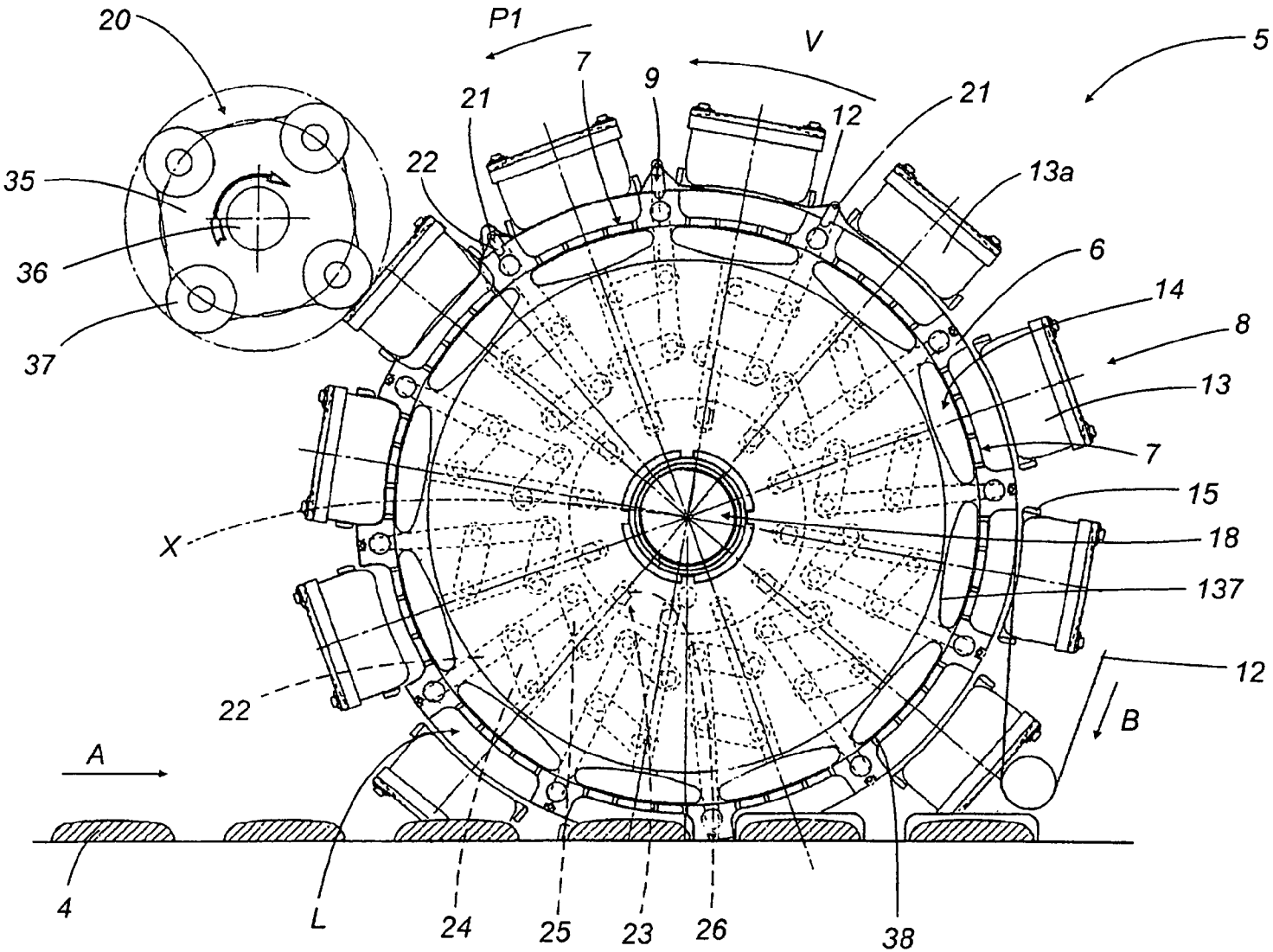
FIG. 3 is a front view of the apparatus of FIG. 2, with some parts in cross section and others cut away for clarity.

As shown in FIGS. 2 and 3, the apparatus 5 basically comprises a drum 6 that revolves about a horizontal axis X and has on its lateral surface a plurality of pockets 7 defining respective impressions L enabling the first web of filter paper 12 to be formed by impression when it is fed over and in contact with the surface of the drum 6 itself; and actuating means 8 for impressing the first web of filter paper 12, said means 8 being mobile along a circular path P (FIG. 7) towards and away from the pockets 7 in synchrony with the drum 6 revolving about the axis X.

More specifically, the actuating means 8 act on the web 12 along at least one arc P1 of the path P (FIGS. 7 and 8) separate from the line A for feeding the web 11 with the product dose 4 on it: in this way, the first web 12 is pressed against each pocket 7 so that the impressions L are formed in it, each being placed over a respective dose 4 of the product and then sealed in known manner to the web of filter paper 11 in such a way as to make the finished pod 1.

Acting in conjunction with the actuating means 8 there are compensating means 9 for collecting portions of the web 12, the means 9 being designed to act on the web of filter paper 12 at least in a part of the aforementioned arc P1 of the circular path P in such a way as to gather and store limited portions of the web 12 for reasons that are explained below.

The apparatus 5 also comprises an associating unit 10 for joining the second web of filter paper 11 to the formed first web of filter paper 12 to make the sealed pod 1, the unit 10 (illustrated only partly in FIG. 2) being located in the vicinity of the drum 6 and under the line A of the filter paper web 11.

Figure 4:
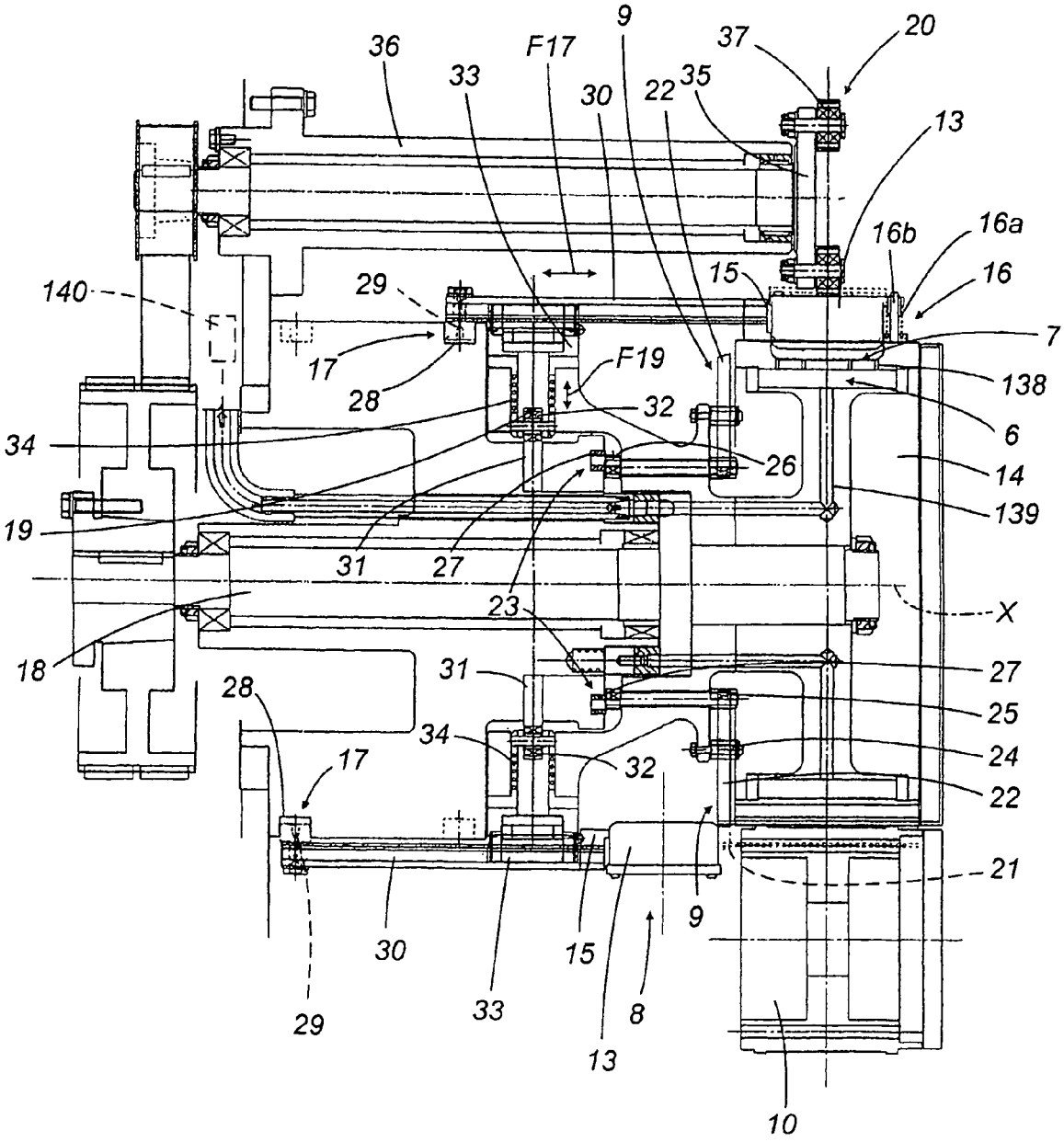
FIG. 4 is a side view in cross section of the apparatus illustrated in FIG. 3.

As shown in more detail in FIGS. 2 and 4, the plurality of pockets 7 are distributed uniformly on the outer surface of the drum 6 so as to continuously form respective impressions L in the first filter paper web 12, each impression L being designed to cover a respective dose 4 positioned on the web 11 on line A.

The web 12 is fed along line B in direction concordant with the direction of rotation V of the drum 6 about its axis X.

Figure 6:
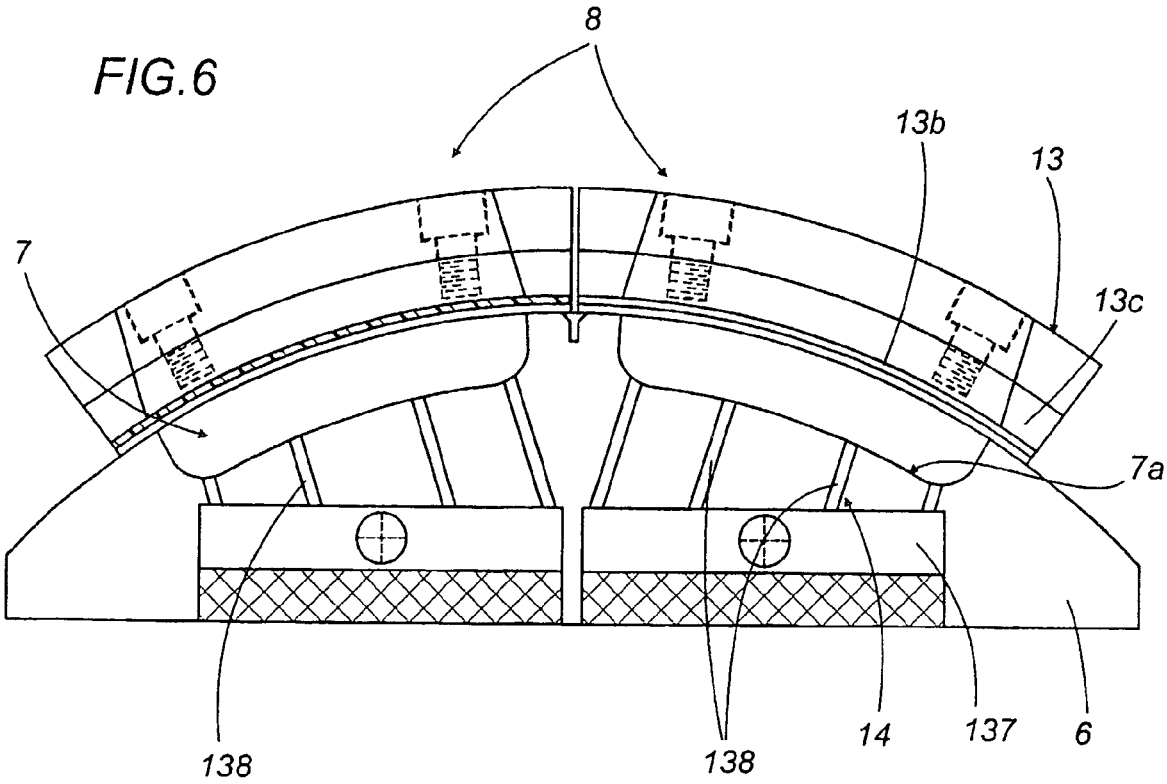
FIG. 6 is a front view, with some parts in cross section and others cut away for clarity, of another embodiment of the apparatus according to the invention.

As shown in FIGS. 2, 3 and 6, the actuating means 8 comprise a plurality of impression forming heads 13 each positioned to face a respective pocket 7 along the arc P1 of the circular path P and shaped to match the pocket 7 on which the first filter paper web 12 is positioned, and suction means 14 located inside each pocket 7 and being switched on during at least one section of the circular path P in such manner as to act in conjunction with the head 13 when the head 13 is lowered into the pocket 7 to form an impression L in a portion of the web 12 inside the pocket 7, and partly switched off when the head 13 is moved away from the pocket 7.

In the preferred embodiment illustrated in FIG. 3, each impression forming head 13 comprises a rigid pressing element or body 13*a* whose shape and size match the shape and size of the pocket 7; whereas in the embodiment illustrated in FIG. 6, the impression forming head 13 comprises a membrane 13*b* of flexible material mounted in and perimetrally fixed to the frame of a rigid plate 13*c*.

In both embodiments, each impression forming head 13 is associated by a radial movement relative to the drum 6 with a plate 15 (FIGS. 2 and 3) for stabilising the edges of the filter paper web 12 in the vicinity of the pocket 7 so as to to enable the top of the pocket 7 to be substantially closed during the step of impressing the first web 12 to form the impressions L.

Between each impression forming head 13 and the related plate 15 there are interposed elastic means 16 (in practice, springs 16*a* visible in FIG. 4) designed to enable the head 13 to at least move away from the pocket 7 when the suction means 14 are partly switched off.

The springs 16*a* are wound around pins 16*b* that act as guides for the radial movement of the head 13 in both directions relative to the plate 15.

As illustrated in more detail in FIGS. 3 and 4, each impression forming head 13 is acted upon by first cam means 17 positioned between the head 13 and a shared shaft 18 for rotating both the drum 6 and the head 13.

The first cam means 17 enable the head 13 to move in a direction parallel to the axis X (see FIG. 2) towards the drum 6, where the head 13 radially faces the pocket 7 along the arc P1 of the circular path P, and then away from the drum 6 along the arc P2 of the circular path P where the first portion 3 of filter material with the product dose 4 on it passes.

Specifically, as shown in FIG. 4, the first cam means 17 of each impression forming head 13 comprise a first cam profile 28 made on the shared shaft 18 and engaged with a first cam follower roller 29 associated with the inside end of a rod 30 that supports the impression forming head 13 and the plate 15, in such manner as to allow the impression forming head 13 to move towards and away from the respective pocket 7, as described above (see arrows F17 in FIGS. 2 and 4).

Each impression forming head 13 is also acted upon by second cam means 19 acting between the head 13 and the shared shaft 18 for rotating the drum 6.

The second cam means 19 permit a radial movement of the head 13, already facing the respective pocket 7, at least at a section T3 of the arc P1 of the circular path P (FIGS. 7 and 8), from a position where it is away from the pocket 7 to a pre-impression position where the head 13 is close to and substantially in contact with the outer perimeter of the pocket 7, and vice versa.

Figure 7:
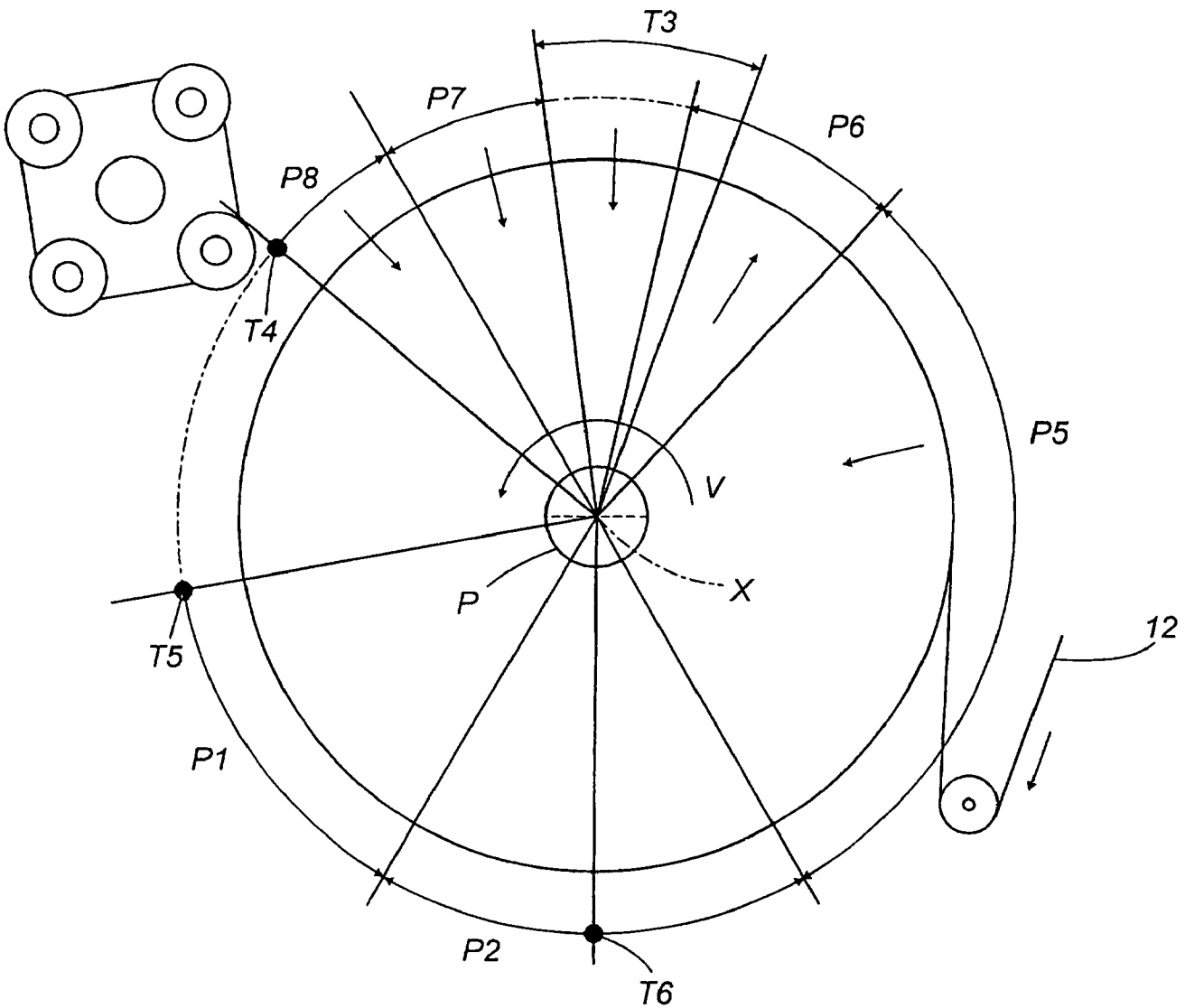
FIGS. 7 and 8 are, respectively, a diagram and a graph representing the process cycle and movements of the parts of the apparatus according to the invention.
Figure 8:
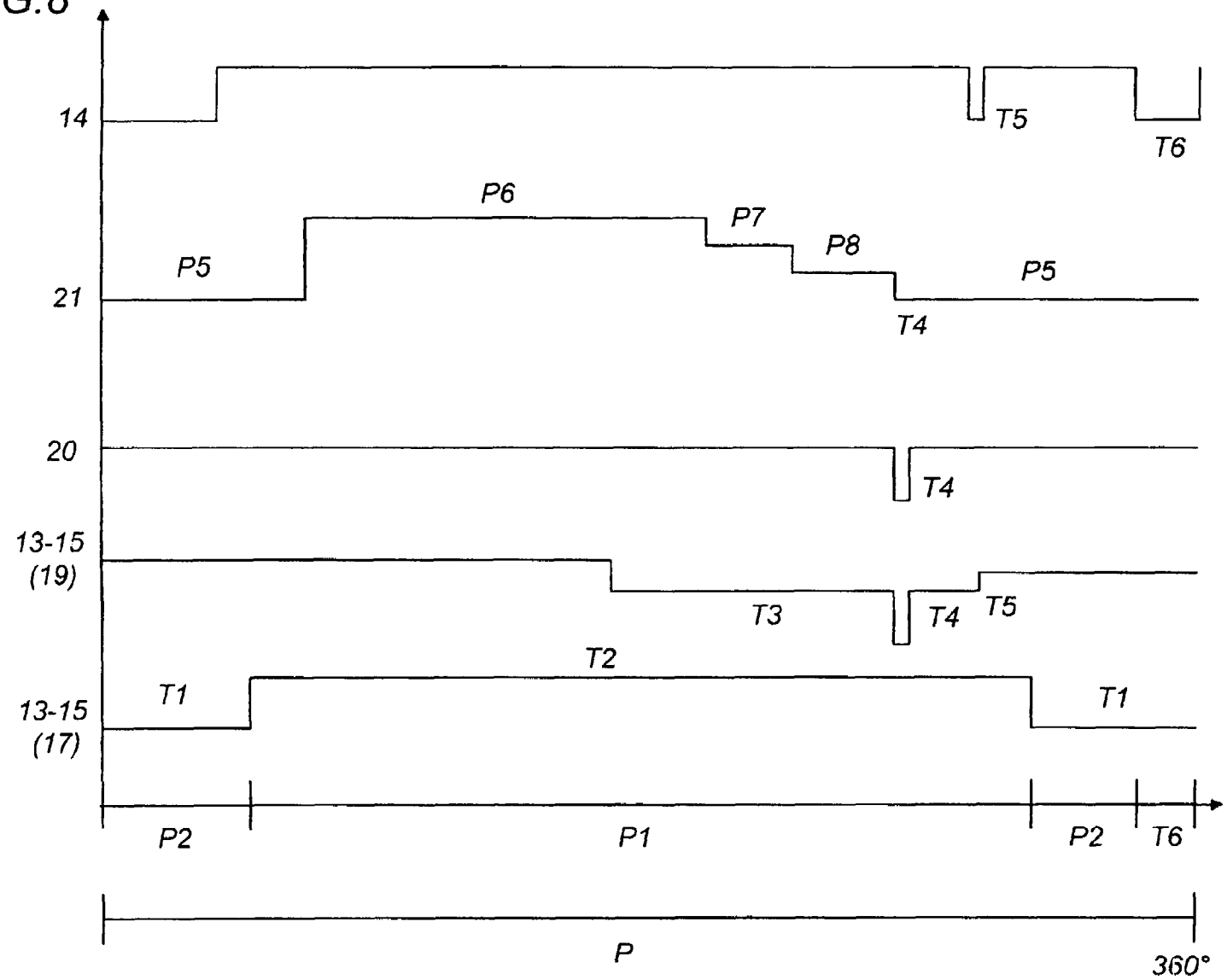

More specifically, as illustrated in FIG. 4, the second cam means 19 comprise a second cam profile 31 made on the shared shaft 18 and engaged with a cam follower roller 32 attached to a carriage 33 that is slidably mounted on the rod 30 that supports the head 13 and the plate 15 and so as to enable the impression forming head 13 to move towards and away from the pocket 7 along a respective arc, included between the arc T3, a point P4 and an endpoint at T5 where the head 13 has returned to the raised position (see arrows F19), according to the process cycle represented in FIGS. 7 and B.

Between the second cam follower roller 32 and the carriage 33 there are interposed spring means 34 designed to damp the downward movement of the impression forming head 13.

In FIGS. 4 and 3, the numeral 20 denotes means for pushing the impression forming head 13 located at a point T4 of the circular path P and acting in conjunction with the suction means 14 to start the downward movement of the impression forming head 13 at the predetermined point T4 of the circular path P.

Looking in more detail, the pusher means 20 comprise a rotating plate 35 connected to a second shaft 36, parallel with the shared shaft 18 for rotating the drum 6 and synchronised with the latter.

The plate 35 is equipped with a plurality of thrust rollers 37 protruding from the plate 35 itself and designed to contact each impression forming head 13 in turn in such a way as to initiate the downward forming movement at the predetermined point T4.

Again with reference to FIGS. 3 and 4, the aforementioned compensating means 9 are positioned on opposite sides of each impression forming head 13 to create a slack excess portion of the web 12 that is taken up during the downward movement of the head 13 to compensate for the filter material that is pushed inside the pocket 7 when the head 13 moves down into the pocket 7.

More specifically, the means 9 comprise a pin 21, positioned between each of the impression forming heads 13 and interposed between the web 12 of filter material and the surface of the drum 6.

In the preferred embodiment illustrated, the pin 21 is associated with a vertical supporting rod 22 positioned behind the drum 6.

The rod 22 is driven by third cam means 23 positioned on the aforementioned shared shaft 18 to allow adoption of a plurality of positions at least along the arc P1 of the circular path P, between a first retracted end position where the pin 21 is substantially below the surface of the drum 6 (that is to say, in a respective slot 6*a* in the drum 6 itself) and a second extended end position where the pin 21 is raised above the surface of the drum 6 so that a certain amount of excess material collects in the vicinity of the forming pocket 7.

The cam means 23 comprise two connecting rods 24 and 25 supporting the rod 22, one of which is equipped with a third cam follower roller 26 engaged with a third cam profile 27 presented by the shared shaft 18 to define a succession of positions adopted by each pin 21 along the circular path P in coordination with the movements of the head 13. More specifically, the positions are the following: a first retracted position, for a first arc P5 (FIGS. 7 and 8) corresponding to a feeding of the web of filter material 12 on the drum 6 and a translational feed movement of a respective impression forming head 13, positioned upstream of the pin 21 relative to the direction of rotation V of the drum 6, towards and radially above the pocket 7; a second raised position, for a second arc P6 where the excess material is collected, and corresponding to the radial movement of the impression forming head 13 towards the pocket 7; a third position where the pin 21 moves one step down in a radial direction, for a third arc P7, towards the surface of the drum 6; a fourth final downstroke position, for a fourth arc P8, when the impression forming head 13 moves down radially into the pocket 7 at point T4 to form the portion 3 of the first web 12.

Figure 5:
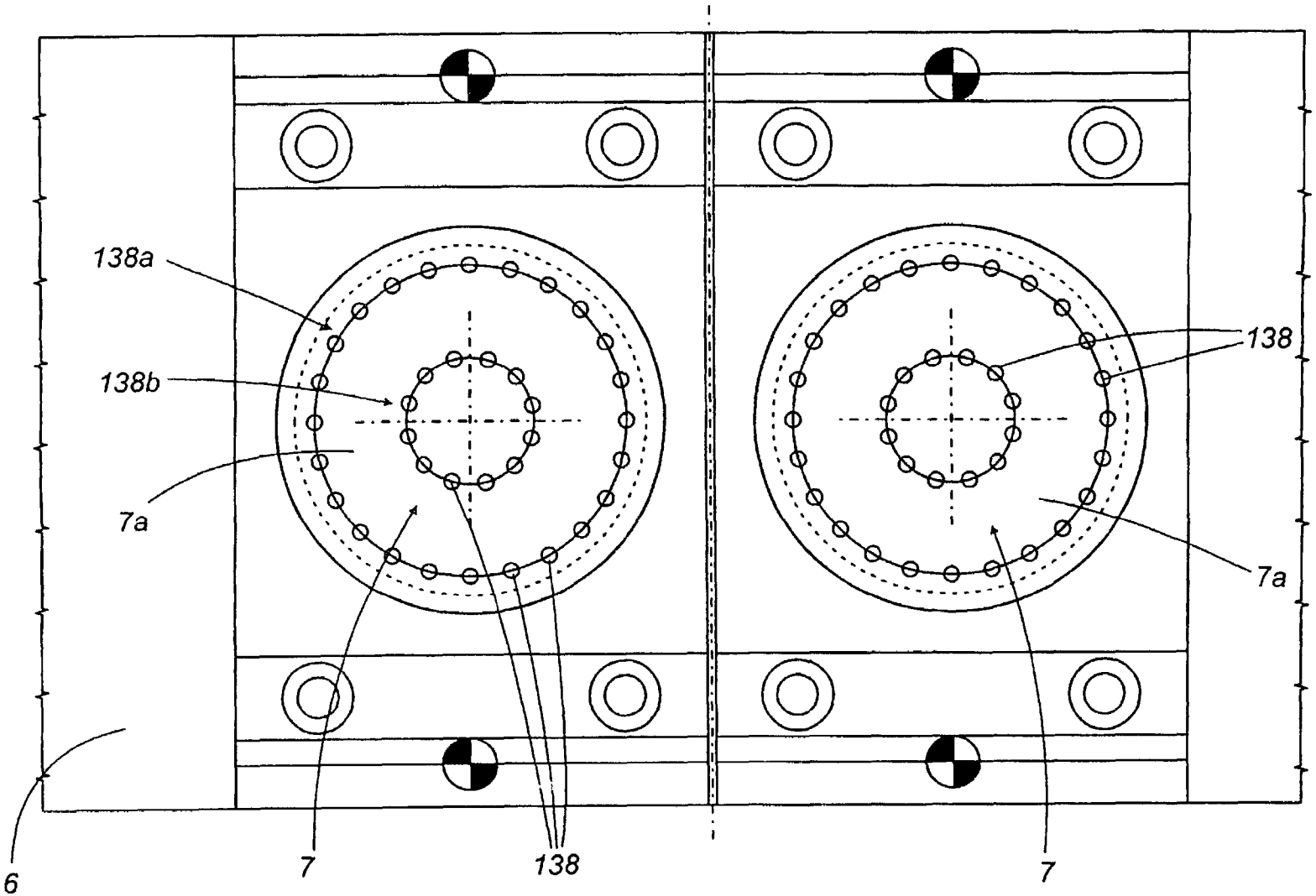
FIG. 5 is a plan view of the apparatus of FIG. 3.

As shown in FIGS. 3, 4 and 5, the aforementioned suction means 14 comprise a chamber 137 located under each pocket 7. The chamber 137 is connected to the pocket 7 through a plurality of holes 138 uniformly distributed on the bottom 7*a* of the pocket 7.

Each chamber 137 is connected, through a respective conduit 139, to a unit 140 for generating a vacuum and designed to distribute the vacuum and to switch it on and off according to the position of the pocket 7 along the circular path P.

In practice, the vacuum remains on for the entire arc P1 of the path P except at point T5, where it is partly switched off to allow the head 13 rise, and at point T6 of the path P2 to allow the formed portion 3 to be released over the dose 4 as it passes on the web 11.

In the accompanying drawings, as a non restricting example of the invention, the product doses 4, the pockets 7 and the impressions L formed in the web 12 are circular in shape and, hence, the head 13, in its rigid version, also has a circular shape.

Similarly, the holes 138 are arranged in such a way as to form at least two concentric circular groups 138*a* and 138*b* to permit better adhesion of the filter paper on the bottom 7*a* of the pocket 7 (see FIG. 5).

On the other hand, if the impression forming head 13 is of the above mentioned membrane type 13*b* (FIG. 6), with a rubber membrane, for example, it may be square or rectangular in shape, held round the edges by a rigid, quadrangular plate 13*c*, and made in such a way as to adapt to the shape of the underlying pocket 7.

To sum up, the operating steps and movements of the components described above with specific reference to FIGS. 7*e* 8 and starting from the point T6 where the impression L is coupled with the dose 4, are as follows:

- a first angular section comprising a part of P1 and of P2 where the head 13-plate 15 assembly is retracted (T1) and the pin 21 upstream of it relative to the direction V, in a lowered position (P5) and the suction means 14 are on;
- a second angular section of P1, immediately following the feeding of the first web 12 to the drum 6, where the head 13-plate 15 assembly starts moving towards the respective pocket 7 and until it is radially superimposed over the pocket 7 (T2), and the pin 21 starts moving up in a radial direction to create the excess material (P6);
- a third angular section where the head 13-plate 15 assembly is lowered radially towards the pocket 7 (T3) and is held there, while the pin 21 moves one step down in a radial direction (P7) to enable the next pin 21' downstream of the head 13 to move up to position P6;
- a fourth angular section where the head 13-plate 15 assembly remains in substantially the same position as before until it reaches point T4 where the head 13 moves down into the pocket 7 under the action of the pusher means 20, while the pin 21 moves all the way down (P8) to allow the impression in the first web 12 to be formed properly;
- a fifth section, extending from point T4 to point T5, where the head 13-plate 15 assembly is held in the impression forming position and the pin 21 in the lowered position until reaching point T5 where the suction means 14 are momentarily switched off to enable the head 13-plate 15 assembly to rise and return to the raised position (T2).
- a sixth section, extending from point T5 to point T6, where the head 13-plate 15 assembly moves back, away from the respective pocket, and the pin 21 remains in the lowered position to allow the passage of the second web 11 with the dose 4 under the drum 6 and suction switched off, at least at point T6, to enable the impression L in the web 12 to be released onto the dose 4.

The apparatus described above offers the following immediate advantages: deep and ample impressions allowing the formation of pods of consistent weight, without creases/folds in the web and, hence, without the possibility of the infusion product escaping, thanks especially to the special design of the forming heads combined with the system for collecting a small amount of excess filter material to compensate for the material pressed down by the heads, which means that all the pods made contain exactly the same amount of infusion product.

It will be understood that the invention can be modified and adapted in several ways without thereby departing from the scope of the inventive concept. Moreover, all the details of the invention may be substituted by technically equivalent elements.

The invention claimed is:

1. An apparatus for making pods containing respective doses of an infusion product, the apparatus comprising:

- revolving drum conveyor means with pockets uniformly distributed on the revolving drum conveyor means;
- a line for feeding a first web of filter material which feeds the first web to the revolving drum conveyor means;

actuating means for moving the first web against the pockets on the revolving drum conveyor means to form on the first web a series of impressions; and a second line for feeding a second web of filter material;

wherein said actuating means is movable along a circular path in synchrony with the revolving drum conveyor means about an axis of rotation of the revolving drum conveyor means; and wherein said actuating means comprises, for each pocket on the revolving drum conveyor means, at least one forming head individually associated with that pocket, the forming head is movable towards and away from the pocket, the forming head being shaped to match a shape of the pocket, wherein the forming head is pressed into the first web and impresses the first web in the pocket to form the respective impression; and suction means acting on the first web at the pocket in synchrony with the forming head.

2. The apparatus according to claim 1, further comprising reciprocating pusher means pressing on the head in such manner as to push the head into the pocket and forming the impression in the first web in conjunction with the suction means acting on the pocket.

3. The apparatus according to claim 2, wherein the suction means are designed to hold the first web and the forming head within the pocket for a defined length of time while the revolving drum conveyor means turn.

4. The apparatus according to claim 1, wherein the suction means are designed to hold the first web and the forming head within the pocket for a defined length of time while the revolving drum conveyor means turns.

5. The apparatus according to claim 1, wherein the forming head comprises a rigid pressing element whose shape and size match a shape and size of the pocket the forming head is coupled with.

6. The apparatus according to claim 5, wherein each forming head is associated with a stabilising plate designed to stabilise the respective edges of the first web at the pocket to enable the top of the pocket to be substantially closed during the step of impressing the first web.

7. The apparatus according to claim 6, further comprising elastic interposition means located between the forming head and the stabilising plate.

8. The apparatus according to claim 1, wherein the forming head includes a rigid frame-like plate and a membrane of flexible material mounted in and perimetrally fixed to the rigid, frame-like plate.

9. The apparatus according to claim 8, wherein each forming head is associated with a stabilising plate designed to stabilise the respective edges of the first web at the pocket to enable the top of the pocket to be substantially closed during the step of impressing the first web.

10. The apparatus according to claim 1, further comprising first cam drive means acting on the head to move the head towards and away from the revolving drum conveyor means over the respective pocket in a direction parallel to the axis of rotation of the revolving drum means themselves; and second cam drive means acting on the head to move the head towards or away from the respective pocket on the revolving drum conveyor means in a radial direction relative to the pocket itself.

11. The apparatus according to claim 1, further comprising compensating means positioned and acting at each forming head to unwind defined lengths of the first web to create a slack excess portion of the first web that is used up by and makes up for the portion that slides towards the pocket when the head moves towards the pocket to form the impression.

12. The apparatus according to claim 11, wherein the compensating means comprise, for each head, a pair of pins located on opposite sides of the head and mobile towards and away from the first web of filter material, under a pushing action of cam means, in a direction substantially radial to the pocket and forming head.

13. The apparatus according to claim 1, wherein the second feed line is defined by the feeding of the second web of filter material which supports an ordered succession of doses of the infusion product, each dose being designed to be associated with a respective impression of the first web.

* * * * *